US011735359B2

(12) United States Patent
McCall et al.

(10) Patent No.: US 11,735,359 B2
(45) Date of Patent: Aug. 22, 2023

(54) PRODUCTION OF PERMANENT MAGNETS USING ELECTROPHORETIC DEPOSITION

(71) Applicant: Lawrence Livermore National Security, LLC, Livermore, CA (US)

(72) Inventors: Scott K. McCall, Livermore, CA (US); Sarah Baker, Dublin, CA (US); Joshua Kuntz, Livermore, CA (US); Jonathan R. I. Lee, Livermore, CA (US); Christine A. Orme, Oakland, CA (US); Marcus A. Worsley, Hayward, CA (US); Alexander A. Baker, Pleasanton, CA (US); Matthew A. Worthington, Livermore, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 276 days.

(21) Appl. No.: 16/020,897

(22) Filed: Jun. 27, 2018

(65) Prior Publication Data

US 2020/0005997 A1 Jan. 2, 2020

(51) Int. Cl.

| | |
|---|---|
| ***H01F 41/26*** | (2006.01) |
| ***H01F 7/02*** | (2006.01) |
| ***C25D 13/12*** | (2006.01) |
| ***C25D 13/02*** | (2006.01) |

(52) U.S. Cl.

CPC ..... *H01F 41/26* (2013.01); *C25D 13/02* (2013.01); *C25D 13/12* (2013.01); *H01F 7/021* (2013.01)

(58) Field of Classification Search

CPC ..... C25D 13/02; C25D 13/12; H01F 41/26; H01F 1/086; H01F 7/021; H01F 1/11; H01F 41/0273

See application file for complete search history.

(56) References Cited

U.S. PATENT DOCUMENTS

| | | | | |
|---|---|---|---|---|
| 4,585,535 | A | 4/1986 | Sher et al. | |
| 4,968,347 | A * | 11/1990 | Ramesh | B22F 1/0003 148/103 |
| 8,968,865 | B2 | 3/2015 | Worsley et al. | |
| 9,062,952 | B2 | 6/2015 | Sullivan et al. | |
| 9,453,289 | B2 | 9/2016 | Rose et al. | |
| 2011/0250467 | A1 * | 10/2011 | Rose | C25D 13/12 428/610 |
| 2013/0257572 | A1 * | 10/2013 | Mccall | C25D 13/02 335/302 |
| 2014/0085022 | A1 | 3/2014 | Wilde et al. | |
| 2016/0163449 | A1 | 6/2016 | Mccall et al. | |
| 2017/0372822 | A1 | 12/2017 | Liang et al. | |

(Continued)

FOREIGN PATENT DOCUMENTS

CN 103996525 A 8/2014

OTHER PUBLICATIONS

E-Magnets UK, "How Neodymium Magnets are made," retrieved from http://www.ndfeb-info.com/neodymium_magnets_made.aspx on Jun. 25, 2018, 6 pages.

(Continued)

*Primary Examiner* — Bernard Rojas

(74) *Attorney, Agent, or Firm* — Zilka-Kotab, P.C.

(57) ABSTRACT

In one embodiment, a magnet includes a plurality of layers, each layer having a microstructure of sintered particles. The particles in at least one of the layers are characterized as having preferentially aligned magnetic orientations in a first direction.

29 Claims, 9 Drawing Sheets

(56) References Cited

U.S. PATENT DOCUMENTS

2020/0027655 A1* 1/2020 Wang ..... H01F 41/0253
2021/0032767 A1* 2/2021 Sio ..... B33Y 40/20

OTHER PUBLICATIONS

Soderznik et al., "The grain-boundary diffusion process in Nd—Fe—B sintered magnets based on the electrophoretic deposition of DyF3," Intermetallics, vol. 23, Dec. 2011, pp. 158-162.
International Search Report and Written Opinion from PCT Application No. PCT/US 19/39286, dated Oct. 1, 2019.
Castle et al., "High coercivity, anisotropic, heavy rare earth-free Nd—Fe—B by Flash Spark Plasma Sintering," Scientific Reports, vol. 7, Article 11134, Sep. 2017, pp. 1-12.
Chang et al., "Influences of Laser SpotWelding on Magnetic Property of a Sintered NdFeB Magnet," Metals, vol. 6, 2016, pp. 1-9.
International Preliminary Examination Report from PCT Application No. PCT/US2019/39286, dated Jan. 7, 2021.

* cited by examiner (a) (b)

PRODUCTION OF PERMANENT MAGNETS USING ELECTROPHORETIC DEPOSITION

The United States Government has rights in this invention pursuant to Contract No. DE-AC52-07NA27344 between the United States Department of Energy and Lawrence Livermore National Security, LLC for the operation of Lawrence Livermore National Laboratory.

FIELD OF THE INVENTION

The present invention relates to permanent magnets, and more particularly, this invention relates to methods of producing permanent magnets using electrophoretic deposition techniques.

BACKGROUND

In modern technology, permanent magnets are essential for energy efficient, lightweight devices such as cell phones, ear buds, and laptops, and are essential in larger quantities (e.g. kilogram to ton quantities) for high efficiency and renewable energy applications such as wind turbines, electric drive, and hybrid motors. The use of permanent magnets in electric motors provides high efficiency in a significantly smaller mass and volume. In the United States, electric motors consume approximately 15% of total electricity usage. Thus, even small increases in electrical motor efficiency have a sizable impact on reduced energy costs and reduced $CO_2$ emissions. For example, a 1% efficiency improvement may translate into savings of hundreds of millions of dollars and a reduction of 2.2 million metric tons of $CO_2$ emissions per year.

Permanent magnets may be graded for merit according to a measure of $(BH)_{max}$ energy product which represents maximum usable energy stored in the magnet. The energy product is a combination of the remanent magnetization ($M_r$), the magnetism retained absent an external magnetic field (total magnetic moment divided by the volume of the magnet), and the coercivity ($H_c$), a measure of the resistance to becoming demagnetized. High coercivity at room temperature is important for motor applications because coercivity generally declines with temperature for conventional magnets. A magnet with high coercivity would retain a large energy product at elevated temperatures. Progress in magnetic materials over the past century has been ascribed to a mastery of coercivity.

The conventional magnets with the highest coercivity are composed of rare earth element-transition metal (RE-TM) materials, where electrons with unpaired spin in the 4f orbitals (4f electrons) from the RE provide high magnetocrystalline anisotropy and 3d electrons of the TM contribute high magnetization and Curie temperature ($T_c$). Typically, the realized coercivity of conventional magnets reach only 25-30% of the theoretical maximum coercivity, after a long optimization of the microstructure to improve magnetic behavior. Moreover, a magnetic material should ideally retain a high coercivity at working temperatures for motor applications which run at temperatures greater than 150° C.

Currently the highest performing magnets in terms of energy product (i.e. $(BH)_{max}$ in units of MG-Oe or energy density in units of $kJ/m^3$) are sintered rare earth permanent magnets. For example, top quality $Nd_2Fe_{14}B$ magnets can have a $(BH)_{max}$ that may exceed 50 MG-Oe (400 $kJ/m^3$). Thus, $Nd_2Fe_{14}B$ magnets, which may include Dy, Tb, and other rare earths, as well as samarium cobalt magnets (e.g. $SmCo_5$ or $Sm_2Co_{17}$). Moreover, all these magnets may include iron (e.g. 5-10% Fe) and, often, vanadium (V), or other elements as minor components (<2%). Furthermore, the most valuable magnetic material is associated typically with high performing magnetic properties in terms of high energy product.

However, although the inexpensive material components of ferrite, an iron oxide based material including additional metallic elements, accounts for ferrite as a dominant permanent magnet material by volume, RE magnets outperform at room temperature all other magnets. Thus, RE permanent magnet materials are preferred in large quantities for hybrid and electric drive motors.

However, the critical materials, such as the rare earth elements (e.g. Sm, Nd, Dy, etc.), essential to these high performing permanent magnets are not easily or affordably obtained, and there are supply chain risks as most of the material is mined in China. Therefore, for reasons of national and economic security as well as general efficiency of manufacture, it would be desirable to improve manufacturing of the permanent magnets to reduce waste and consumption of the critical materials.

Conventional manufacturing of permanent magnets involves methods of compacting powder, for example, producing a desired alloy and turning the alloy into a powder (e.g. hydrogenation disproportionation desorption recombination (HDDR) or melt-spinning, either of which may be followed by jet milling). The powders are then compacted (e.g. by pressing) and sintered under inert atmospheres, followed by magnetization and dicing, grinding, etc. to achieve the appropriate size and shape. A final step may include coating the magnet to prevent corrosion of the magnet material.

There are several drawbacks for these current methods of manufacture of permanent magnets. In particular, for smaller magnets, particularly those under a few millimeters in size, the amount of waste (e.g. swarf, kerf, etc.) generated by these conventional manufacturing techniques may be as much as 80% of the total material volume. For example, much of the kerf generated by dicing becomes contaminated with cutting fluids, other impurities which make its reuse impractical. Magnets produced in this manner are also uniform in material concentration.

RE magnets are very brittle and readily chip, so precision machining of magnets to high tolerances significantly adds to production costs, including the costs of breakage during fabrication. Machining permanent magnets using a subtractive process results in significant waste of the valuable material.

Alternative conventional manufacturing techniques may involve producing bonded magnets using injection molding or similar techniques. These methods form bonded magnets that include a mixture of magnetic particles combined with a polymer binder such that this mixture is extruded, molded, or rolled into sheets and geometric shapes.

However, there are drawbacks with the methods of forming bonded magnets. In particular, the presence of the bonding agent (e.g. epoxy, thermoplastic, etc) in the final product causes the bonded magnets to have lower energy densities than sintered magnets. Moreover, bonded magnets typically function at modest temperatures because of the temperature sensitivity of the bonding agent present in the bonded magnets.

It would be desirable to develop efficient methods of additive manufacturing (AM) techniques for the manufacture of permanent magnets. However, AM methods prefer powders with particles that are spherical in shape that have high flowability. Anisotropic Nd—Fe—B powders having desirable magnetic properties include particles with sharp edges and high aspect ratios (length versus cross-section), but as such, have poor flowability. Additionally, many AM techniques apply directed energy methods to the powders wherein the materials are melted to create a part. The act of melting destroys the microstructure of the permanent magnet material, and effectively eliminates the coercivity necessary for high energy product magnets. Thus, methods for manufacturing permanent magnets with reduced waste (as typically generated by subtractive machining) and reduced loss of energy (as typically occurs with blending with polymers) have been elusive.

SUMMARY

In one embodiment, a magnet includes a plurality of layers, each layer having a microstructure of sintered particles. The particles in at least one of the layers are characterized as having preferentially aligned magnetic orientations in a first direction.

In another embodiment, a product includes a part having a plurality of layers of sintered magnetic anisotropic particles, where the part is characterized by physical characteristics of formation by an electrophoretic deposition process.

In yet another embodiment, a method of forming a magnet includes forming a structure by electrophoretic deposition (EPD) and sintering the formed structure to form a magnet. The forming a structure by EPD includes adding a plurality of first particles having magnetic anisotropy to an electrophoretic deposition (EPD) chamber and applying a voltage differential across electrodes of the EPD chamber to create an electric field in the EPD chamber for causing electrophoretic deposition of the first particles above a first of the electrodes for forming a first layer comprising the first particles.

Other aspects and advantages of the present invention will become apparent from the following detailed description, which, when taken in conjunction with the drawings, illustrate by way of example the principles of the invention.

DETAILED DESCRIPTION

Figure 1B:
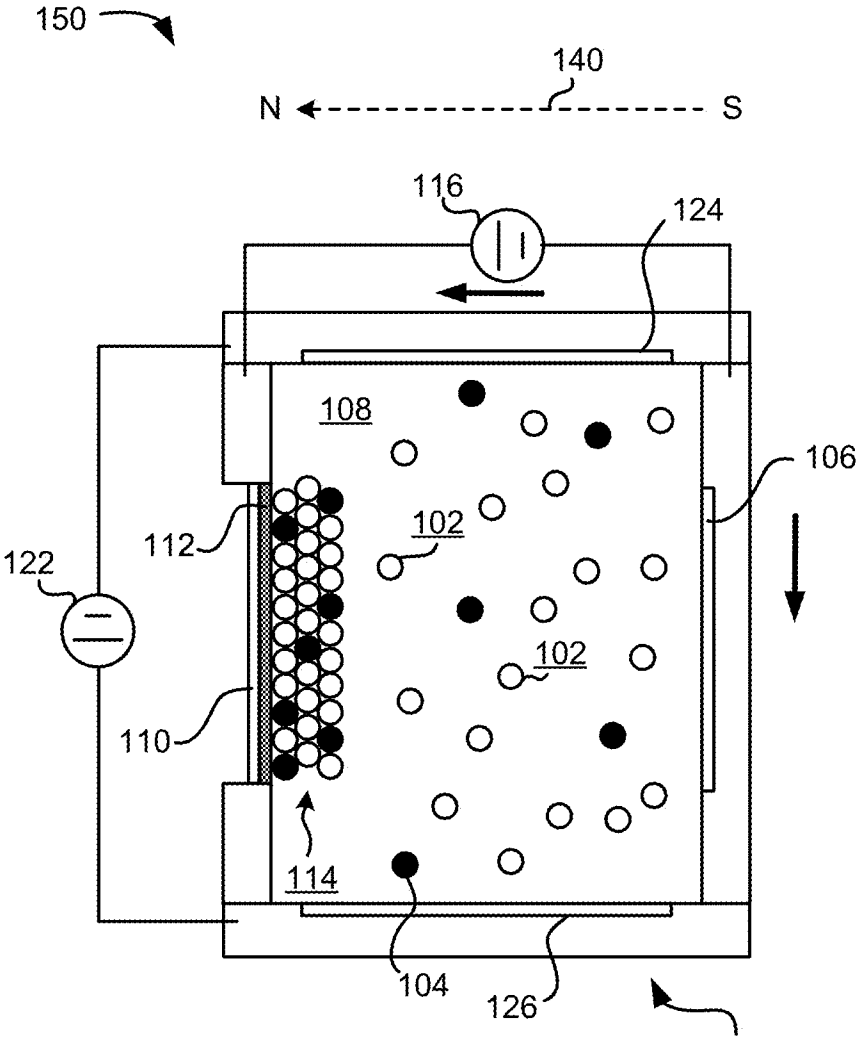
FIG. 1B is a schematic drawing of a system for electrophoretic deposition, according to one embodiment.

The following description is made for the purpose of illustrating the general principles of the present invention and is not meant to limit the inventive concepts claimed herein. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an" and "the" include plural referents unless otherwise specified.

The nanoscale is defined as between 1 nanometer and about 500 nanometers.

The following description discloses permanent magnets formed by electrophoretic deposition and/or related systems and methods.

In one general embodiment, a magnet includes a plurality of layers, each layer having a microstructure of sintered particles. The particles in at least one of the layers are characterized as having preferentially aligned magnetic orientations in a first direction.

In another general embodiment, a product includes a part having a plurality of layers of sintered magnetic anisotropic particles, where the part is characterized by physical characteristics of formation by an electrophoretic deposition process.

In yet another general embodiment, a method of forming a magnet includes forming a structure by electrophoretic deposition (EPD) and sintering the formed structure to form a magnet. The forming a structure by EPD includes adding a plurality of first particles having magnetic anisotropy to an electrophoretic deposition (EPD) chamber and applying a voltage differential across electrodes of the EPD chamber to create an electric field in the EPD chamber for causing electrophoretic deposition of the first particles above a first of the electrodes for forming a first layer comprising the first particles.

A list of acronyms used in the description is provided below.

3D Three dimensional
$(BH)_{max}$ Energy product
C Celsius
cm centimeter
$CO_2$ Carbon dioxide
Dy Dysprosium
DyF3 Dysprosium(III) fluoride
EPD Electrophoretic deposition
FGM Functionally graded material
$H_c$ coercivity
HDDR hydrogenation disproportionation desorption recombination
K Kelvin
kJ kilojoule kOe kilo Oersteds
mg milligram
$M_r$ Remnant magnetization
MGOe MegaGauss-Oersteds
mm millimeter
Nd Neodymium
NdFeB Neodymium Iron Boride ($Nd_2Fe_{14}B$)
nm nanometer
RE-TM rare earth element-transition metal
SmCo Samarium Cobalt
T Tesla
Tb Terbium
$T_c$ Curie Temperature
V volts
VSM Vibrating sample magnetometer Some embodiments described herein are directed to efficiently producing homogeneous magnets via electrophoretic deposition, while others are directed to producing magnets with specifically tailored properties. Producing functionally graded materials (FGM) that include gradients in composition, microstructure, and/or density may enhance bulk properties, which typically correspond to a combination of the precursor material properties. It would be desirable to use processing techniques to produce FGM magnets, with minimal waste and maximum cost efficiency. Various techniques described herein use electrophoretic deposition (EPD) technology to fabricate functionally graded, nanostructured magnetic materials tailored in three-dimensions that may be sintered to produce a permanent magnet with FGM and magnetism.

The EPD processes described herein may use methodology based on the techniques disclosed in U.S. patent application Ser. No. 13/085,405, which is incorporated by reference. Basically, the EPD process is an additive technique that allows virtually all material deposited to remain in the final product, thereby creating near net-shape parts. Moreover, material remaining in solution in the EPD chamber, that has not been deposited, may be reused in subsequent depositions thereby sharply reducing any generation of waste.

EPD is an additive manufacturing process that allows construction of near net shape materials with low levels of waste, and so may be useful for producing parts from expensive materials. Thus, in various embodiments described herein, EPD produces pre-defined shapes that are desirable for permanent magnets such as cylinders, arcs, parallelepipeds, etc.

Materials

Materials with magnetic properties, as understood herein, include materials and composites having magnetic properties as would be understood by one having ordinary skill in the art upon reading the present application.

Materials with magnetic anisotropy have a directional dependence of the magnetic properties of the materials. For example, the magnetic moment of the magnetically anisotropic materials as described herein aligns along an easy axis, which is an energetically favorable direction of spontaneous magnetization.

In addition, formulations that form a permanent magnet as understood herein include material that retains magnetization and creates a persistent magnetic field after an external magnetizing field has been removed.

According to various embodiments described herein, the formulations of permanent magnets may include magnetic material and non-magnetic material, and material with varying degrees of magnetism. As such, EPD can be used to deposit at least one component of the formulation, so long as the final product comprises a magnetic part, as would be understood by one having ordinary skill in the art upon reading the present descriptions. Additionally and/or alternatively, the synthesis of a final part may involve multiple steps, some of which do not employ EPD.

Materials conventionally used in permanent magnets may be used in various embodiments. Illustrative materials with magnetic anisotropy generally include Neodymium Iron Boride ($Nd_2Fe_{14}B$), samarium cobalt ($SmCo_5$, $Sm_2Co_{17}$), ferrites, etc. In various embodiments described herein the material may include at least one of: neodymium, cobalt, samarium, iron, nickel, ferrite, boride, other rare earth elements, etc., and combinations thereof, as would be understood by one having ordinary skill in the art upon reading the present descriptions. In some approaches, the permanent magnet may include an alloy comprised of a combination of at least two materials. In some approaches, the permanent magnet may include a combination of materials. In some approaches the EPD process may be used with pre-cursor materials, such as oxides or fluorides of what will become the magnetic material.

In preferred approaches, the EPD process may be used to additively manufacture permanent magnets using powders of the starting materials. In particular powders having magnetic anisotropic properties (e.g. the particles having a magnetic moment that will align with an easy axis) have not been useful for conventional AM methods because anisotropic particles of magnetic powders (e.g. Nd—Fe—B powders) in solution have poor flowability. However, since EPD uses powders dispersed in a fluid, flowability may not be an essential parameter for the EPD process.

Thus, magnetic anisotropic powders having particles with high aspect ratios, such as Nd—Fe—B, may be suspended in solution and deposited in pre-defined three-dimensional (3D) shapes during the EPD process. In some approaches, magnetic structures may be formed by EPD with powders having a magnetic characteristic of being highly anisotropic.

In some approaches, the formulation of the permanent magnet may include non-magnetic materials deposited during the EPD process, for example, but not limited to aluminum (Al) for structural support, zinc (Zn) for corrosion resistance, etc. Additionally, or alternatively, these secondary materials may be added to tailor the magnetism of the permanent magnet in a manner that would become apparent to one having ordinary skill in the art upon reading the present descriptions, such as a soft magnetic material of a particular geometry to shape the magnetic field of the permanent (hard) magnet.

Moreover still, composites suitable for deposition by EPD and use in relevant applications described herein may additionally and/or alternatively include secondary agents for modifying electrochemical properties of the particles of the magnetic material(s) upon suspension in a dispersion liquid. Such agents might include: a second phase of magnetic material to create an exchange spring magnet, a material to improve strength and fracture toughness, a functional material to create a multiferroic device, etc. The primary advantage of including such secondary agents is to facilitate and/or confer electrophoretic mobility of the particles of the magnetic material by conveying and/or tuning the surface charge of the particles. Exemplary secondary agents include salts, acids, bases, ions, etc. In operation, secondary agents may convey, modify and/or tune particle surface charge by any suitable means as understood by skilled artisans, such as by modifying solution pH, salt concentration, ion concentration, etc. as would be understood by one having ordinary skill in the art upon reading the present descriptions.

In some embodiments, particles automatically acquire a surface charge upon suspension in the dispersion liquid, and in others, particles of the magnetic materials suspended in the dispersion liquid acquire a surface charge upon addition of one or more secondary agents and mixing of the secondary agent, magnetic material particles, and dispersion liquid as discussed herein.

Mixing and suspension of magnetic materials, secondary materials, and/or secondary agents in a dispersion liquid may be achieved by any suitable means appreciable by skilled artisans upon reading the present descriptions, including stirring, shaking, vortexing, applying ultrasonic energy, etc. Mixing should be performed in any manner sufficient to suspend the magnetic material particles in the dispersion liquid, and, while homogenous suspensions may confer advantages including enhanced deposition uniformity and/or efficiency, reduce deposition time necessary to achieve a particular deposition thickness, etc. as would be understood by one having ordinary skill in the art upon reading the present descriptions, the suspension need not be homogenous according to the present disclosure.

Dispersion liquids suitable for use within the scope of the present descriptions include any liquids capable of supporting a suspension of magnetic material particles, secondary materials, and/or secondary agents as described herein. The dispersion liquid may be an aqueous or organic solution. In preferred approaches, the solution is a nonpolar solution that may contain an effective amount of an aqueous solution to impart a charge on the particles in solution without providing an environment for hydrolysis. In preferred approaches, the solution in the EPD chamber is essentially free of hydrolysis reactions. The effective amount of an additive is an amount that imparts the desired function or result, and may be readily determined without undue experimentation following the teachings herein and varying the concentration of the additive, as would become apparent to one skilled in the art upon reading the present description. Exemplary approaches include solutions that include ethanol, carbonate, etc. as would be understood by one having ordinary skill in the art upon reading the present descriptions.

In general, the achievable thickness is dependent upon parameters such as the identity of a substrate material, if included, and the magnetic material(s), the strength of the electric field applied during deposition, the deposition time, etc. but may be difficult to predict without attempting experiments to determine the optimum deposition conditions. However, one skilled in the art, upon reading the present descriptions, would be able to make such determinations for various materials via experimentation, without resorting to undue experimentation.

Accordingly, it is possible to co-deposit materials of differing identity and/or composition provided that each material exhibits similar electrophoretic mobility and/or deposition behavior, enabling synthesis of complex combinations of energetic materials and/or binding agents, in various embodiments.

EPD Devices

Figure 1A:
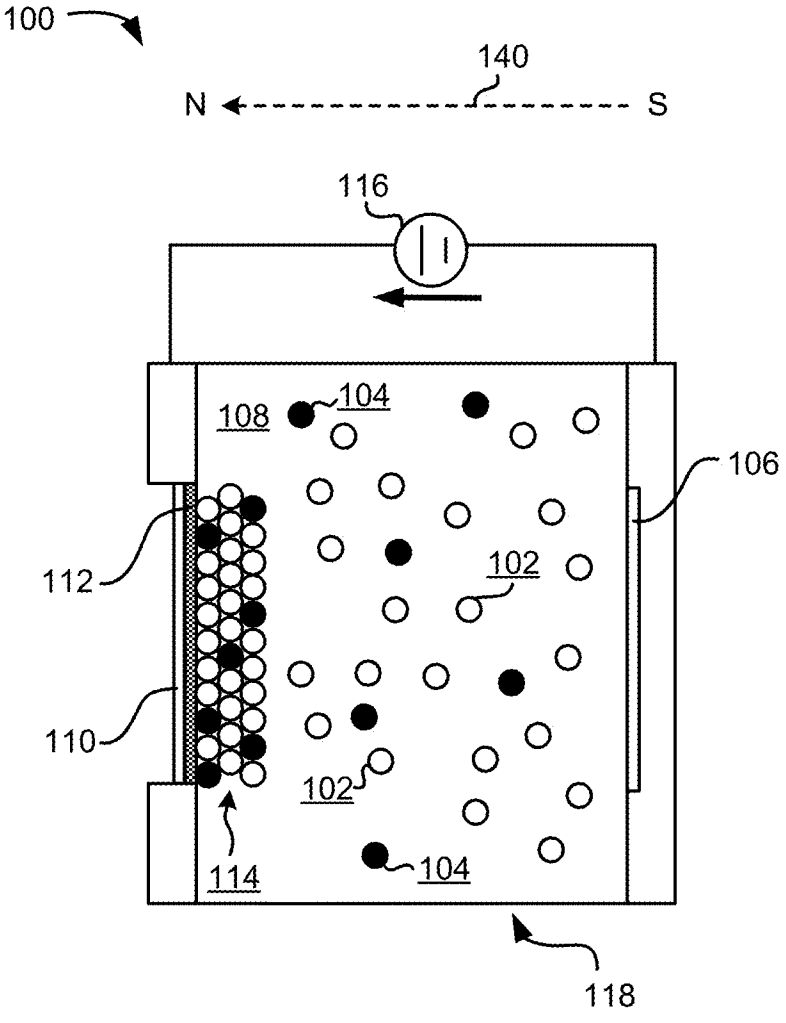
FIG. 1A is a schematic drawing of a system for electrophoretic deposition, according to one embodiment.

As shown in FIG. 1A, an EPD device 100 may include a first electrode 110 and a second electrode 106 positioned on opposite sides of an EPD chamber 118, with a voltage differential 116 applied across the two electrodes 106, 110 that causes charged nanoparticles 102 and/or particles 104 in a suspension 108 to move toward the first electrode 110 as indicated by the arrow. In some embodiments, a substrate 112 (e.g. a conductive substrate, a nonconductive substrate coupled to a conductive electrode, a nonconductive substrate platted with a conductive substance, etc.) may be placed on a solution side of the first electrode 110 such that nanoparticles 114 may collect thereon. In some approaches, the substrate may be a metal. In other approaches, the substrate may be a non-metal, e.g. silicon.

Thus, in one approach, a product may include a primarily nonconductive substrate having a conductive portion upon which at least one material with magnetic properties is electrophoretically deposited.

In another approach, the product may include a nonconductive structure, where at least one material with magnetic properties is positioned in and/or around the structure.

The EPD device 100, in some embodiments, may be used to deposit materials with magnetic properties on or above the first electrode 110 or a conductive substrate 112 positioned on a side of the electrode 110 exposed to a suspension 108 (e.g. dispersion) including the magnetic material as nanoparticles 102 in suspension 108, and/or particles 104 in suspension 108 to be deposited. By controlling certain characteristics of formation of structures in an EPD process, such as the precursor material composition (e.g., homogenous or heterogeneous nanoparticle solutions) and orientation (e.g., non-spherical nanoparticles), deposition rates (e.g., by controlling an electric field strength, using different solvents, etc.), particle self-assembly (e.g., controlling electric field strength, particle size, particle concentration, temperature, etc.), material layers and thicknesses (e.g., through use of an automated sample injection system and deposition time), and deposition patterns with each layer (e.g., via use of an electrode having an area corresponding to the desired pattern, via use of electrode each having an area corresponding to the desired portion of a pattern, dynamic electrode patterning, etc.), intricate and complex structures may be formed using EPD processes that may include a plurality of densities, microstructures, and/or compositions, according to embodiments described herein.

Now regarding FIG. 1B, an EPD device 150 substantially identical to the EPD device 100 shown in FIG. 1A is shown as a simplified schematic, according to one embodiment. EPD device 150 includes all components as described above regarding EPD device 100, and additionally includes a second voltage differential 122 applied across electrodes 124, 126 which influences the movement of nanoparticles 102 and/or particles 104 in the suspension 108. The precise influence on the movement of nanoparticles 102 and/or particles 104 depends on the type of field generated (e.g. alternating current (AC), direct current (DC), constant, pulse, etc.), the strength of the field, and the duration of application, as will be understood by persons having ordinary skill in the art upon reading the present descriptions. Of course, additional electrodes may be included in EPD devices according to the present descriptions in various locations in and/or around the EPD chamber, such as above and/or below the plane of the images depicted in FIGS. 1A and 1B, among other positions.

Figure 1C:
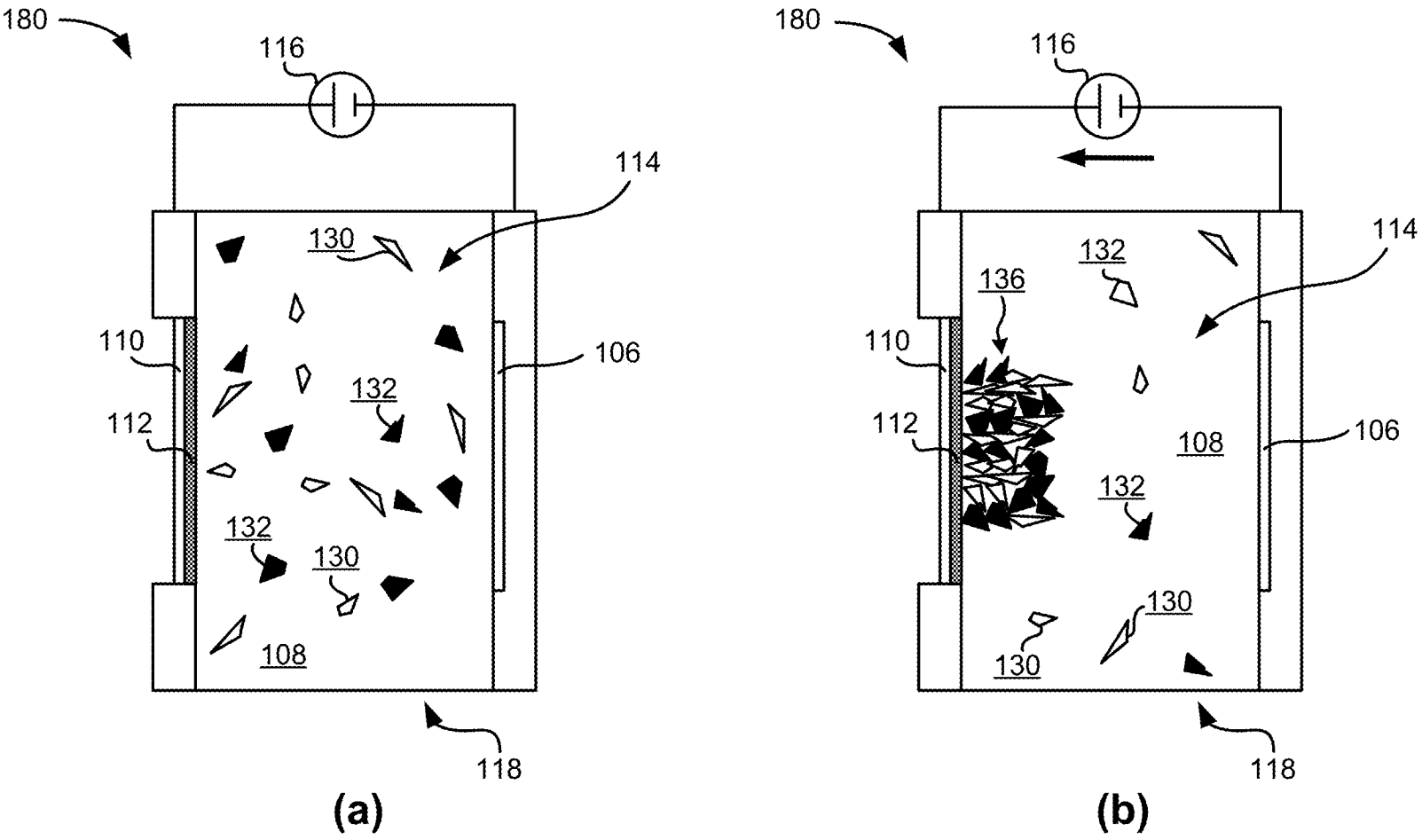
FIG. 1C is a schematic drawing of a system for electrophoretic deposition, according to one embodiment.

Turning to FIG. 1C, an EPD device 180 substantially identical to the EPD device 100 shown in FIG. 1A, is shown in a simplified schematic according to one embodiment. EPD device 180 includes all the components as described above regarding EPD device 100, and includes a suspension 108 of particles 130, 132 of different shapes and sizes that may be characteristic of particles of a magnetic highly anisotropic powder. As shown in the part (a) of FIG. 1C, in the absence of an applied voltage, the particles 130, 132 remain suspended in the suspension 108. Part (b) of FIG. 1C shows the deposition of particles 130, 132 into a plurality of layers 136 on a substrate 112 of or adjacent a first electrode 110 during generation of a voltage differential 116 applied across electrodes 110, 106.

As depicted in part (b) of FIG. 1C, particles having sharp edges and/or high aspect ratios (length versus cross section (e.g. particle 130)) may be easily dispersed in suspension 108 and deposited onto a substrate 112 thereby forming a plurality of layers 136 during an EPD process using an EPD device 180.

Other components and/or resulting products shown in FIGS. 1A-6 of the EPD devices 100, 150, 180, 600 and devices not specifically described herein may be chosen, modified, and/or optimized according to any number of factors, such as size limitations, power requirements, formation time, etc., as would be known by one of skill in the art upon reading the present disclosure.

Figure 2C:
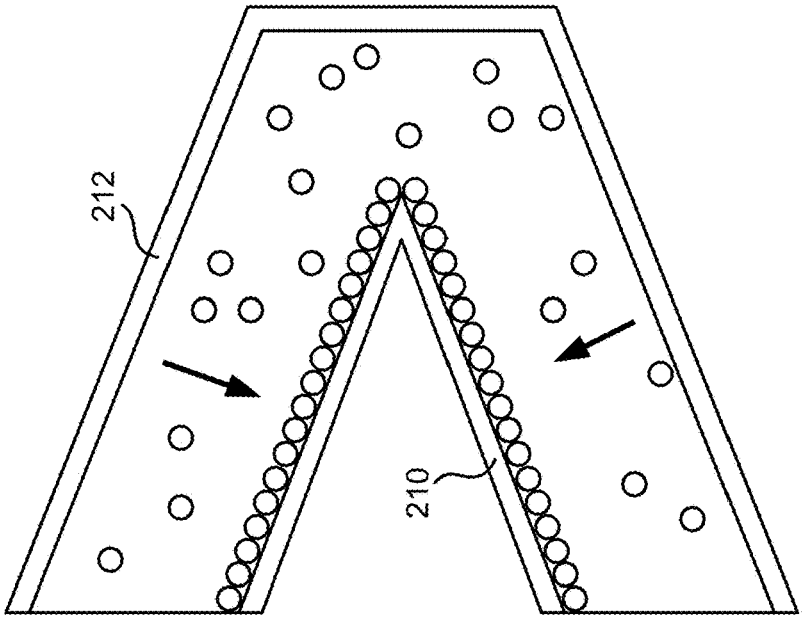
FIGS. 2A-2C are schematic drawings of non-planar electrodes, according to various approaches.
Figure 2B:
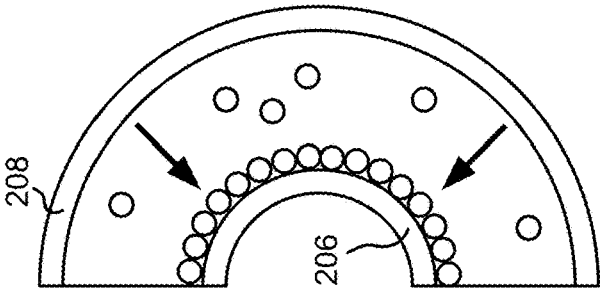
Figure 2A:
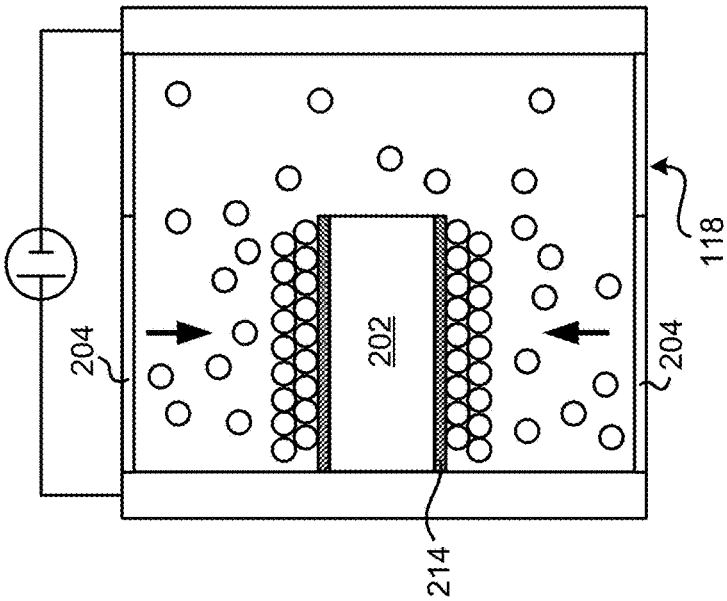

In another approach, the substrate and/or electrode may have a non-planar shape, e.g., it is cylindrical, polygonal, conical, etc. FIGS. 2A-2C show electrode configurations for EPD, according to various embodiments. In FIG. 2A, an EPD device is shown with a non-planar electrode configuration. The first electrode 202 extends from an end of the EPD chamber 118, while the second electrode 204 is positioned apart from the first electrode 202 at a substantially equal distance, thereby providing an electric field to cause deposition when a voltage differential is applied across the electrodes 202, 204. In this or any other embodiment, the first electrode 202 may have a circular profile, a polygonal profile, a curved profile, etc. The shape of the first electrode 202 may be chosen to correspond to a desired shape of the deposited material and subsequent structure formed therefrom in some embodiments. In some embodiments, as shown in FIG. 2A, a layer 214 may be positioned between the first electrode 202 and the second electrode 204, which may be a conductive layer, a substrate, a coating, etc., as previously described.

Now referring to FIG. 2B, the first electrode 206 may comprise a curved surface according to one embodiment, with the second electrode 208 being positioned at substantially a constant distance apart, thereby providing a more uniform electric field upon application of a voltage differential between the electrodes 206, 208. The first electrode 206 may have a continuously curved surface, or may have portions thereof that are curved, with other portions planar or flat, according to various embodiments.

As shown in FIG. 2C, according to another embodiment, the first electrode 210 may have a conical surface, which may have a circular or polygonal profile, with the second electrode 212 being positioned at about a constant distance apart.

Of course, FIGS. 2A-2C are exemplary electrode configurations, and any combination of curved, flat, circular, polygonal, or any other shape as known in the art may be used for electrode design, particularly in an attempt to adhere to application requirements, as described herein. The invention is not meant to be limited to the electrode configurations described herein, but may include electrode configurations of any type as would be understood by one of skill in the art upon reading the present descriptions. For example, deposition may be performed in reverse, e.g. onto the second electrodes 204 (FIG. 2A), 208 (FIG. 2B), 212 (FIG. 2C), respectively.

In some embodiments the substrate may comprise an electrode, and in preferred embodiments may comprise a patterned electrode. In one embodiment, the substrate may be characterized as a planar substrate, while in another embodiment the substrate may be characterized as a non-planar substrate, such as a lattice. In even further embodiments, the substrate may be a porous structure.

Properties of Magnets Produced by EPD

Notably, the products producible by employing the presently described EPD process(es) include a composite of particles, at least some of which are magnetic, where the composite has physical characteristics of being formed by an EPD process. Such characteristics include, but are not limited to deposition conformal to a surface of a substrate, a tuned volumetric magnetic density, highly precise film thickness, highly precise particle packing density, a particular particle orientation, a particular deposition pattern (2D or 3D), etc. as would be understood by one having ordinary skill in the art upon reading the present descriptions. In preferred embodiments, each physical characteristic may be selected and/or customized by tuning deposition conditions.

Since EPD confers the ability to control the deposition of both material with magnetic properties and material without magnetic properties, it enables creation of highly controllable magnetic materials, in some approaches.

Equation 1 sets out the basic system-level model for electrophoretic deposition, where $W_{film}$ is the mass of the deposition layer, μ is the electrophoretic mobility, E is the electric field, A is the area of the electrode substrate, C is the deposition particle mass concentration, and t is the deposition time.

$$W_{film}=\int_{t1}^{t2}\mu EACdt \qquad \text{Equation 1}$$

Combining these principles with dynamic patterning and sample delivery (which is described in more detail later), electrophoretic deposition may be employed to produce a diverse set of products with unique and/or difficult to obtain shapes, designs, and properties custom-fitted to any of a number of practical applications.

Figure 3A:
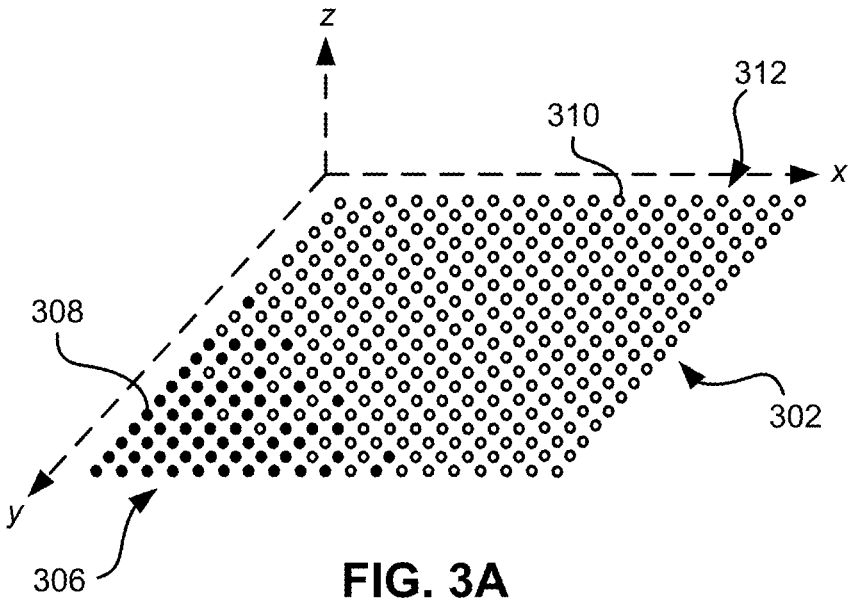
FIG. 3A-3B are schematic drawings of electrophoretic deposition of material in one layer, according to one embodiment.
Figure 3B:
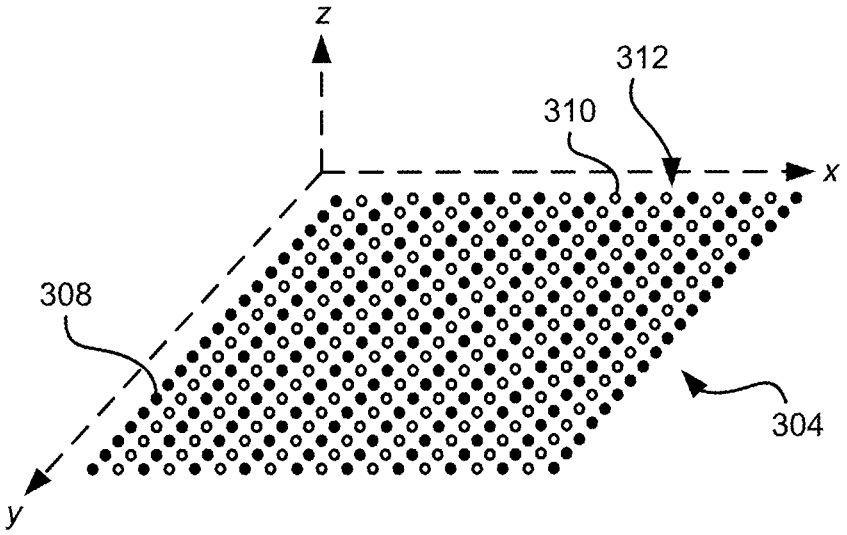
Figure 3C:
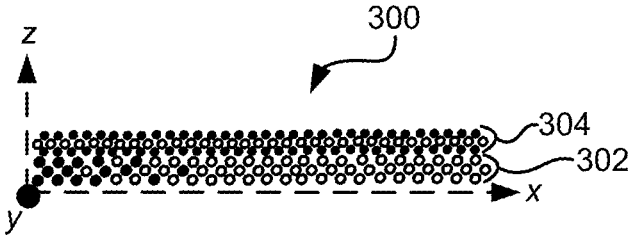
FIG. 3C is schematic drawing of electrophoretic deposition of more than one layer in a z-direction, according to one embodiment.

Now referring to FIGS. 3A-3C, according to one embodiment, a magnetic material 300 comprises a first layer 302 oriented in an x-y plane of deposition.

As shown in FIG. 3A, the x-y plane is represented in an isometric view of a simplified schematic diagram of a single layer 302, which is represented by a plurality of first particles 308 (shown as black dots) and/or second particles 310 (shown as white dots). The black dots and/or white dots may represent a density of the layer (such as the black dots representing a more dense volume, with the white dots representing a less dense volume), a composition of the layer (such as the black dots representing a first material, e.g. a magnetic material, and the white dots representing a second material, e.g. a non-magnetic material and/or second magnetic material), a microstructure of the layer (such as the black dots representing a first lattice structure, with the white dots representing a second lattice structure), etc. as would be understood by one having ordinary skill in the art upon reading the present descriptions.

Of course, the embodiments described herein are not meant to be limiting on the invention in any way. Also, the patterns are not limited to those shown in FIGS. 3A and 3B, and may include any shape (polygonal, regular, irregular, etc.), repeating pattern (single pixels, lines, shapes, areas, etc.), random array (e.g., a predefined composition of materials with a random arrangement, such as a 25%/75% material A/material B split, a 50%/50% material A/material B split, etc.), etc.

In some embodiments described herein functionally graded structures may be formed by changing out the deposition solutions during the EPD process. Thus, deposition of an expensive material may be strategically used for a final product, e.g. a permanent magnet.

For example, and not meant to be limiting in any way, Dy is a desirable component of Nd—Fe—B magnets as Dy increases the coercivity and resistance to demagnetization, however, Dy also reduces the magnetic remanence and is very expensive. In some approaches of methods described herein, the EPD process may define locations for Dy in the permanent magnet where large demagnetizing fields occur. Thus, Dy in solution may be selectively deposited to a green body thereby improving overall performance of the magnet while reducing the material cost.

In some approaches, a $Nd_2Fe_{14}B$ system may have layers of Dy rich Dy—Fe—B. In some approaches, $DyF_3$ from a solution of $DyF_3$ particles may be selectively deposited on the magnet in areas where large demagnetizing fields will be applied.

According to one embodiment, as shown in FIG. 3A, the gradient of the first layer 302 may be defined by a first material 306 having first particles 308 in a first pattern and by a second material 312 having second particles 310 being arranged in a second pattern, where the first pattern is complementary to the second pattern. The term "complementary" indicates that one pattern does not overlay the other pattern, but gaps may remain between the patterns where no material is deposited, in some approaches. In other approaches, the second pattern may be a reverse or negative pattern of the first pattern, e.g., similar to red and black squares of a checker board. Of course, any pattern may be used for the first and second patterns as would be understood by one of skill in the art upon reading the present descriptions, including patterns that are not complementary. In more approaches, the patterns may be changed as material is deposited, causing even more variations to material formation, layering, etc.

In another embodiment, at least the first material 306 and/or the first layer 302 may have a characteristic of being deposited through an EPD process according to the first pattern. This characteristic may include, in some embodiments, smooth, gradual gradients between the materials in the first layer 302, abrupt transitions from the particles 308 of first material 306 to the particles 310 of a second material 312 in the first layer 302, regular patterning between the first material 306 and the second material 312, or any other characteristic of deposition through an EPD process as would be understood by one of skill in the art upon reading the present descriptions. In a further embodiment, at least the first material 306 may have a characteristic of being deposited through the EPD process above a non-planar electrode. For example, the non-planar electrode may have a cylindrical shape, a regular polygonal shape, a conical shape, a curved surface shape, or any other non-planar shape as would be understood by one of skill in the art upon reading the present descriptions. Illustrative non-planar electrodes are described in more detail above.

In another embodiment as shown in FIG. 3B, at least the first particles 308, the second particles 310 of the second material 312 and/or the second layer 304 may have a characteristic of being deposited through an EPD process according to one or more patterns. In a further embodiment, at least the first particles 308, the second particles 310 of the second material 312 and/or the second layer 304 may have a characteristic of being deposited through the EPD process above a non-planar electrode, as described previously.

In another embodiment, each layer may employ one or more unique patterns and/or materials, thereby creating a structure which, in the z-direction perpendicular to the x-y plane, may have differing arrangements of materials.

As would be understood by one of skill in the art upon reading the present descriptions, in some embodiments one or more additional layers may be arranged above the first layer 302 and the second layer 304, thereby forming a structure that may have complex layering and/or composition.

FIG. 3C depicts a schematic drawing of a side view of the material 300 where the z direction is perpendicular to the x-y plane. In one approach, the material 300 may have a second layer 304 above the first layer 302, where the second layer 304 may be configured to form a gradient in composition, microstructure and/or density in a z-direction perpendicular to an x-y plane of the first layer 302. The second layer 304 of the material may be defined by a second material 312 (FIG. 3B).

According to various embodiments, at least the first material, a second material, an $n^{th}$-material, etc. of the first layer, second layer, $n^{th}$ layer may have a characteristic of being deposited through an EPD process. This characteristic may include, in some embodiments, smooth, gradual gradients between the materials in the first layer, abrupt transitions from the first material to the second material in the first layer and/or the second layer, regular patterning between the first material and the second material, or any other characteristic of deposition through an EPD process as would be understood by one of skill in the art upon reading the present descriptions. In a further embodiment, at least the first material may have a characteristic of being deposited through the EPD process above a non-planar electrode. For example, the non-planar electrode may have a cylindrical shape, a regular polygonal shape, a conical shape, a curved surface shape, or any other non-planar shape as would be understood by one of skill in the art upon reading the present descriptions.

In some approaches, a characteristic of deposition through an EPD process may include characteristics of the second material being deposited after the first material is deposited.

In various embodiments as illustrated in FIGS. 3A-3B, the first material 306, the second material 312, the $n^{th}$-material of the first layer 302, second layer 304, $n^{th}$ layer may include at least one of: neodymium, cobalt, samarium, iron, nickel, ferrite, boron, alloys comprising a combination thereof, etc. In some approaches, the material of the first layer may be different from the material of the second layer. In other approaches, the material of the first layer may be the same as the material of the second layer.

In one embodiment, products incorporating magnetic materials as described herein may include a thin film containing particles of one or more magnetic materials, and the thin film may be disposed on one or more surfaces of a substrate. Importantly, the thin film of magnetic materials incorporated into such products may preferably exhibit one or more physical characteristics of electrophoretic deposition, as discussed in detail above.

Of course, the patterns shown in FIGS. 3A-3C are not limiting on the invention in any way, and any patterns may be used as would be understood by one of skill in the art upon reading the present descriptions. In some approaches, the first, second, third, and/or fourth patterns may overlay one another and/or be coexistent therewith.

Figure 4A:
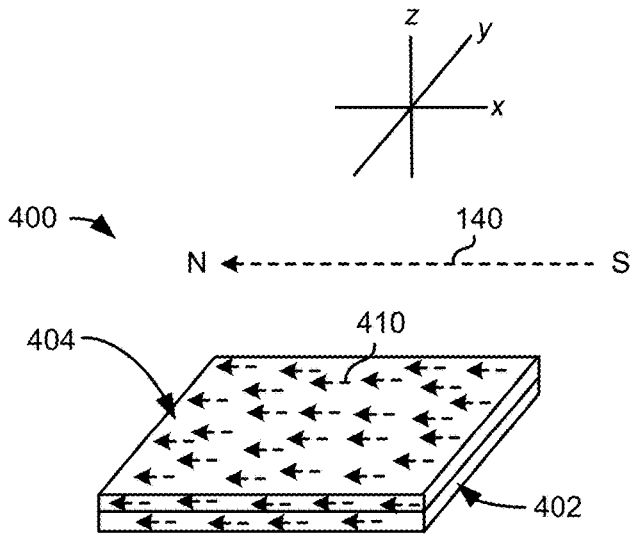
FIG. 4A is a schematic drawing of a structure formed by EPD, according to one embodiment.

FIG. 4A depicts a magnet 400, in accordance with one embodiment. As an option, the present magnet 400 may be implemented in conjunction with features from any other embodiment listed herein, such as those described with reference to the other FIGS. Of course, however, such magnet 400 and others presented herein may be used in various applications and/or in permutations which may or may not be specifically described in the illustrative embodiments listed herein. Further, the magnet 400 presented herein may be used in any desired environment.

FIG. 4A depicts a schematic drawing of a 3D view of a magnet 400, according to one embodiment, that includes a plurality of layers 402, 404, of which each layer has a microstructure of sintered particles, which itself may be a monolayer or particles or have a thickness of several times the average particle diameter. The particles in at least one of the layers 402, 404 may be characterized as having commonly aligned magnetic orientations 410 in a first direction corresponding to the direction of a magnetic field 140 applied to the particles during deposition. The magnet 400 may be characterized by physical characteristics of formation by an electrophoretic deposition process. In some approaches, the magnet 400 is a permanent magnet.

In some approaches, the magnet 400 may have a gradient of composition, microstructure and/or density in a thickness direction of the layers.

In some approaches, the magnet 400 having a plurality of layers may include a first layer 402 and a second layer 404 formed above the first layer 402. As would be understood by one of skill in the art upon reading the present descriptions, one or more additional layers may be arranged above the first layer and the second layer, thereby forming a structure that may have complex layering and/or composition, with gradients possible in the x-y plane and the z-direction across some or all of the layers, in a plethora of combinations.

In some approaches, at least one of the layers of the magnet 400 may have a gradient in composition, microstructure and/or density in at least one direction, e.g., in the x-y plane and/or in the z direction. In some approaches, the magnet may have a plurality of layers that includes a first layer 402 and a second layer 404 formed above the first layer 402, where the first layer 402 and/or the second layer 404 have a gradient in composition, microstructure and/or density in a z-direction perpendicular to an x-y plane of the first layer 402.

The first and second layers 402, 404 may have a gradient that includes a transition from a first characteristic of the first layer 402 to a second characteristic of the second layer 404. Characteristics of the gradients may include composition, microstructure, and density. For example, in some approaches, a gradient may include a transition from the composition of the first layer to a composition of the second layer where the composition of the second layer is different from the composition of the first layer.

In some approaches, the gradient may include a transition from a microstructure of the first layer to a microstructure of the second layer where the microstructure of the second layer is different from the microstructure of the first layer.

In some approaches, the gradient may include a transition from a density of the first layer to a density of the second layer where the density of the second layer is different from the density of the first layer.

In some approaches, the second layer 404 may have a gradient in composition, microstructure and/or density in an x-y plane oriented parallel to a plane of deposition of the first layer 402. The gradient of the first and second layer 402, 404, according to various approaches, may be smooth, abrupt, or comprised of small, incremental steps, and combinations thereof.

This gradient in the z-direction may be used in addition to or in place of a gradient in the x-y plane of each layer based on patterns, e.g., and may be formed by changing solutions in an EPD chamber during EPD processing (see FIG. 6), in one approach.

Looking back to FIG. 3C as an example, the material 300 may be a precursor to a magnet 400 having gradient of composition, microstructure, and/or density in a thickness direction (z direction) of the layers 302, 304. Furthermore, the first layer 302 may be defined by a first material 306 having a plurality of anisotropic particles. The anisotropic particles may be represented by the first particles 308 (white dots) and/or second particles 310 (black dots) as shown in FIGS. 3A 3C.

Returning to FIG. 4A, the magnet 400 may be characterized as having magnetic properties. According to one embodiment, the magnet 400 may be at least partially characterized by physical characteristics of being deposited by an electrophoretic deposition process. The magnet 400 may have magnetic anisotropy such that the magnetism of the part is aligned along an easy axis from S to N. In some approaches, the magnetic orientation 410 (e.g. the magnetic moment) of the anisotropic particles of the layers 402, 404 may be aligned along a common axis. In some approaches, the first layer 402 may be characterized as having a commonly aligned magnetic orientation 410 in a first direction, e.g., a S to N direction. In some approaches, the second layer 404 may have similar magnetic properties as the first layer 402.

In other approaches, the second layer 404 may have different magnetic properties than the first layer 402. In some approaches, the particles of the second layer may be characterized as having a commonly aligned magnetic orientation in a second direction that is different from the first direction, for example different from a S to N direction (as shown in FIG. 4A). For example, graded magnetic fields in which a first layer has a commonly aligned magnetic orientation that is different from a second layer of a magnet may have application in guides or traps for particles. Moreover, a Halbach array may use embodiments or teachings described herein to assemble a rotating pattern of permanent magnets in one piece.

In some approaches, the magnet may have coercivity greater than 10 kilo Oersteds (kOe) at temperatures of at least 300° C. In some approaches, the magnet may have coercivity of greater than 10 kOe at a temperature of about 300° C. In some approaches, the magnet may have coercivity of greater than 10 kOe at a temperature of about 400° C. In some approaches, the magnet may have a coercivity of greater than 40 kOe at temperatures above 100° C. In some approaches, the magnet may have coercivity above 50 kOe at room temperature (e.g. 300 K or in a range of about 20° C. to about 25° C.).

In some embodiments, the EPD system may be combined with a magnetic field generator such that the packing density and/or magnetic properties of the deposited material may be improved. In some approaches, the EPD flow cell may be placed in a magnetic field, preferably a uniform magnetic field, so that the particles are aligned in the magnetic field as the particles are deposited along the electric field lines. Looking to FIGS. 1A-1B, an externally applied uniform magnetic field 140 may be applied to anisotropic particles 102, 104. For example, and not meant to be limiting, a uniform magnetic field may be applied to the EPD chamber 118 so that the magnetic moment of the particles 102, 104 may be commonly aligned as the particles are deposited on the substrate 112 toward the first electrode 110 according to the applied electric field. In some approaches, as shown in FIG. 1B, the uniform magnetic field 140 may be applied in a direction parallel to the electric field created by the voltage differential 116. In other approaches, the magnetic field may be applied in a direction perpendicular to the electric field created by the voltage differential or any other desired direction.

Figure 4B:
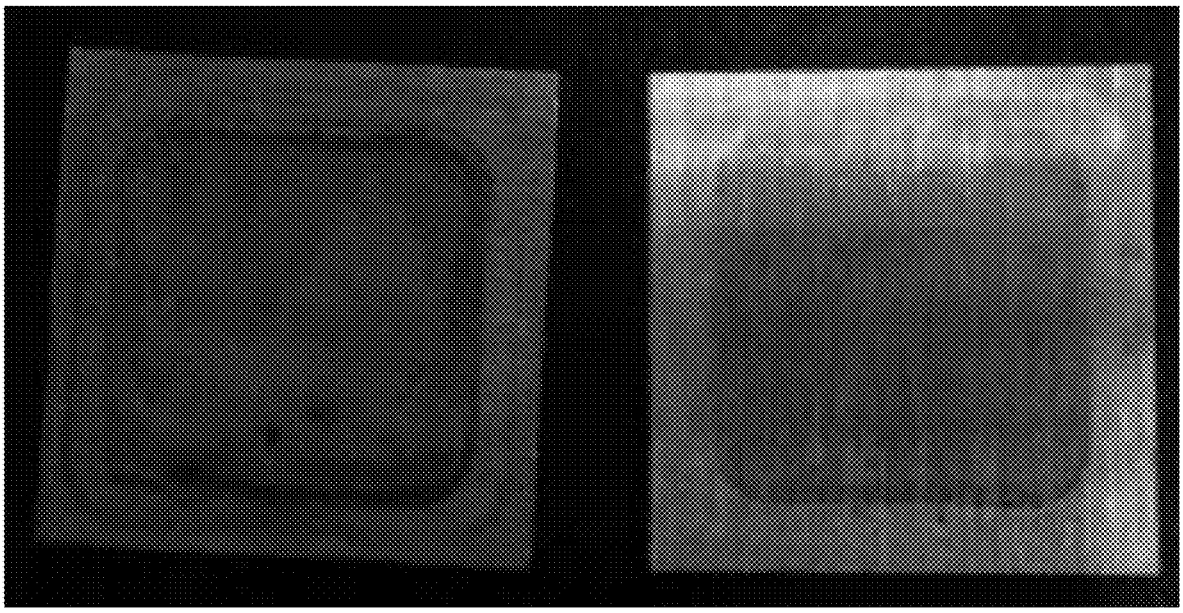
FIG. 4B includes images of (a) the first electrode with a 3D structure formed thereon, according to one embodiment, and (b) the second electrode.

By way of example, but not limited to the images shown, part (a) of FIG. 4B represents an example of a green body of magnetic anisotropic particles formed on a first electrode by an EPD process. Part (b) of FIG. 4B is an image of the second electrode from the EPD chamber that formed the green body in part (a) of FIG. 4B. It is again important to note that the dimensions (width, height, aspect ratio, etc.), and shape of the green body as disclosed herein serve only as an example and are not limiting in any way, as various embodiments may include larger or smaller dimensions and/or different shapes.

According to one embodiment, the magnet 400 is a permanent magnet. In some approaches, the permanent magnet may have a thickness in the z-direction in a range of greater than about 5 nanometers and less than about 1 centimeter.

In some approaches, a permanent magnet may be a thin film permanent magnet. In one approach, the thickness of the thin film permanent magnet may be about 3 atoms thick. In other approaches, the thin film permanent magnet may have a nanoscale thickness.

In various embodiments, a permanent magnet may have a plurality of layers having a physical characteristic of being deposited by an EPD process, as described earlier.

In some approaches, the plurality of layers of the permanent magnet may have a physical characteristic of being deposited above a non-planar electrode, e.g., as described for FIGS. 2A-2C.

In some approaches, each layer of the permanent magnet may individually include one or more of the following materials: neodymium, cobalt, samarium, iron, nickel, ferrite, boride, and a combination thereof. Accordingly, one layer may have one material and a second layer may have another material in combination with a third material. In some approaches, more than one layer may have the same material. For example, one layer of the permanent magnet may have iron, a second layer may have iron with neodymium, and a third layer may have samarium. In some approaches, any layer may include an alloy of more than one of the materials.

In some approaches, the first and second layers may include a same material in each respective composition, e.g., both layers include the same material along but each includes another material that is exclusive to that particular layer.

In one embodiment, a product includes a part having a plurality of layers of sintered magnetic anisotropic particles. The part may be characterized by physical characteristics of formation by an electrophoretic deposition process. In various approaches, the part is a permanent magnet.

In some approaches, the part may have a gradient of composition, microstructure and/or density in a thickness direction of the layers. In some approaches, the part may have a thickness in a range of greater than about 5 nanometers and less than about 1 millimeter.

In some approaches, each layer of the part individually includes at least one of the following materials: neodymium, cobalt, samarium, iron, nickel, ferrite, boride, or a combination thereof. Accordingly, one layer may include one material and a second layer may include a different material. Moreover, one layer may include an alloy of two materials and a second layer may include one of the materials. These examples are not exhaustive, and any combination of materials may be used for each layer, as would be understood by one skilled in the art reading this description.

Figure 5B:
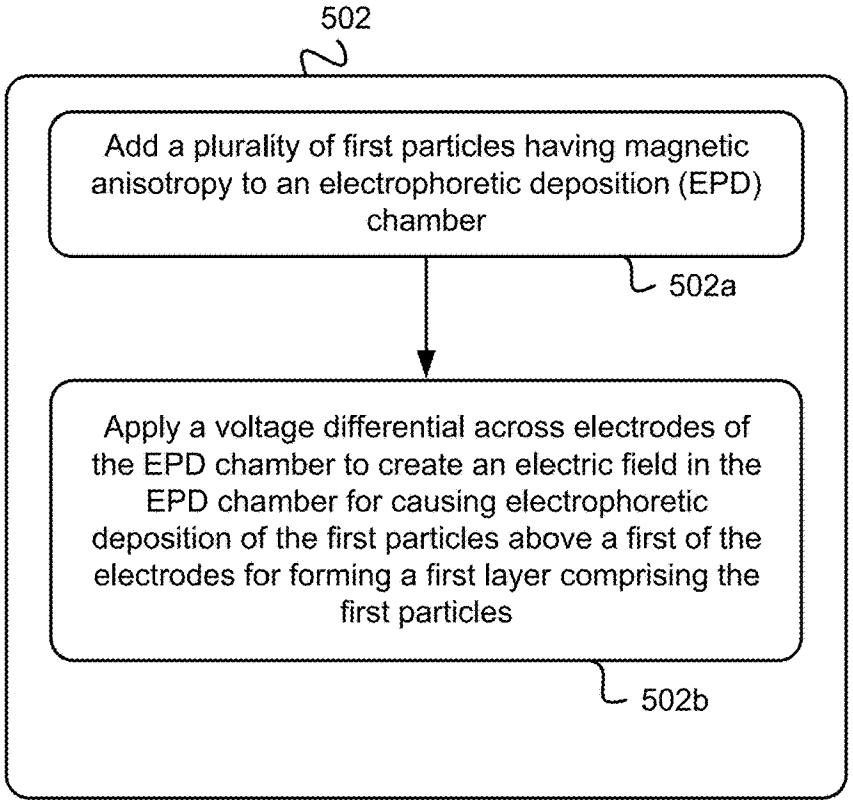
FIGS. 5A-5B is a flow chart of a method of forming a functionally graded magnet, according to one embodiment.
Figure 5A:
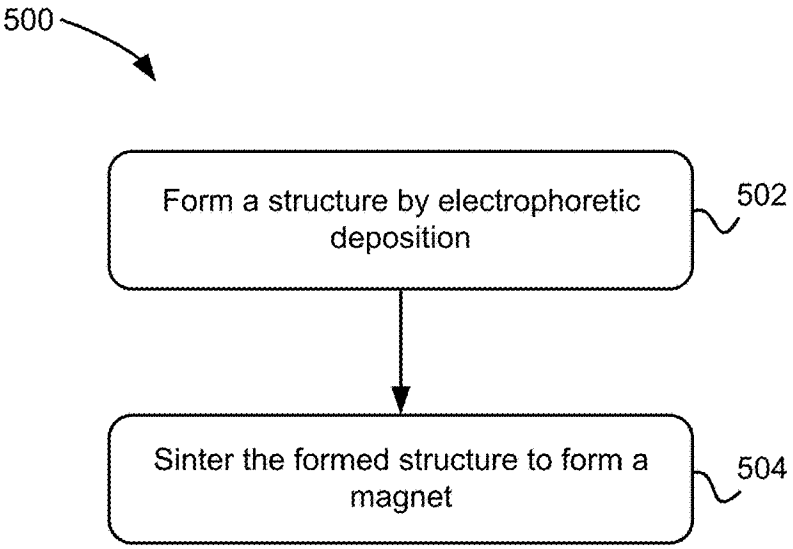

FIGS. 5A-5B depict a flowchart for a method 500 for forming a magnet, in accordance with one embodiment. As an option, the present method 500 may be implemented to structures such as those shown in the other FIGS. described herein. Of course, however, this method 500 and others presented herein may be used to form structures for a wide variety of devices and/or purposes which may or may not be related to the illustrative embodiments listed herein. Further, the methods presented herein may be carried out in any desired environment. Moreover, more or less operations than those shown in FIGS. 5A-5B may be included in method 500, according to various embodiments. It should also be noted that any of the aforementioned features may be used in any of the embodiments described in accordance with the various methods.

A method 500 of forming a magnet includes a first operation 502 of forming a structure by EPD that may include a series of sub-operations 502*a*, and 502*b*, as shown in FIG. 5B.

Sub-operation 502*a* includes adding a plurality of first particles having magnetic anisotropy to an electrophoretic deposition (EPD) chamber. In some approaches, sub-operation 502*a* may include adding a solution of particles to the EPD chamber, where the solution includes a first material to be deposited onto a surface.

Sub-operation 502*b* includes applying a voltage differential across electrodes of the EPD chamber to create an electric field in the EPD chamber for causing electrophoretic deposition of the first particles above a first of the electrodes for forming a first layer comprising the first particles. Looking back to FIG. 1A, a schematic diagram of an electrophoretic deposition chamber 118 is shown with a first electrode 110 and a second electrode 106. The EPD chamber may be oriented in any position with the electrodes on opposite sides of the chamber, for example, but not meant to be limiting, in some approaches, the electrodes may be positioned on the top and bottom of the chamber. In other approaches, the electrodes may be positioned on the opposite sides of the chamber (as shown in FIG. 1A). Other components shown in the EPD device 100 illustrated in FIGS. 1A-1B, the EPD device 600 illustrated in FIG. 6, and not specifically described herein may be chosen, selected, and optimized according to any number of factors, such as size limitations, power requirements, formation time, etc., as would be known by one of skill in the art.

In some approaches of method 500, operation 502 may include applying a magnetic field to the EPD chamber during the electrophoretic deposition for aligning magnetic orientations of the particles in a common direction. In some approaches, the magnetic field may be applied in a direction parallel to the electric field formed by the applied voltage differential in the EPD chamber. In other approaches, the magnetic field may be applied in a direction perpendicular to the electric field formed by the applied voltage differential in the EPD chamber.

In some approaches, at least one of the layers may include a plurality of particles of one material and a plurality of particles of a second material, where magnetic orientations of the particles of the first material and the particles of the second material are commonly aligned in a same direction.

In various approaches, the EPD chamber includes a solution having the first material to be deposited therein. In other approaches, the EPD chamber may include a solution having a first material of particles and a second material of particles.

In various approaches, the electric field between the electrodes in the EPD chamber causes the first particles to form a particle packing density gradient in a direction consistent with the electric field.

In some approaches, sub-operation 502*b* may include electrophoretically depositing the first material above a first electrode according to a first pattern for forming a first layer including the first material. The first layer may be defined by the first particles being commonly aligned in the magnetic field. In various approaches, as would be understood by one of skill in the art upon reading the present descriptions, one or more additional layers may be arranged above the first layer and the second layer, thereby forming a structure that may have complex layering and/or composition, with gradients possible in the x-y plane and/or the z-direction in and/or across some or all of the layers, e.g., as shown in FIG. 3A-3C.

In various approaches, the formed structure of operation 502 may be a 3D structure. In other approaches, the formed structure of operation 502 may be a thin film.

In some embodiments, the first electrode 110 (as in FIGS. 2A-2C) may have a non-planar shape. In another embodiment, as following methodology disclosed in U.S. patent application Ser. No. 13/085,405, which is incorporated by reference, EPD with shaped graphite or machined metal electrodes with non-planar geometries may be used to create green-bodies with complex shapes. This technique can be combined with any of the previously described techniques to simultaneously achieve a defined nano- or microstructure. Potential applications include magnet prototypes with a radius of curvature greater than about 2 inches made from a single precursor material. Using graphite as an electrode material, complex electrode geometries may be created which provide a contour for the bulk part during deposition. Using finite element modeling as a guide, the electrode shapes and the resulting electric fields may be controlled such that they are conducive to rapid and dense deposition of material.

In other approaches of operation 502 of FIG. 5B, forming a structure may include introducing a solution having a second material into the EPD chamber, applying a voltage differential across the first electrode and the second electrode, and electrophoretically depositing a second layer above a first layer, where the first layer may be defined by a first material and the second layer may be defined by a second material. In addition, the deposition of the first and second materials may form a gradient in composition, microstructure and/or density in the respective layer along an x-y plane oriented parallel to a plane of deposition of the first layer.

In some approaches, introducing a solution having a second material into the EPD chamber may include expelling the solution having the first material from the EPD chamber prior to introducing the solution having the second material into the EPD chamber. In this way, more abrupt transitions from the electrophoretically deposited first material to the electrophoretically deposited second material may be made, whereas slowly introducing the second material (such as in a solution having the second material therein) into the EPD chamber while the first solution is still present may result in more gradual transitions from the first material to the second material in the green body.

Figure 6:
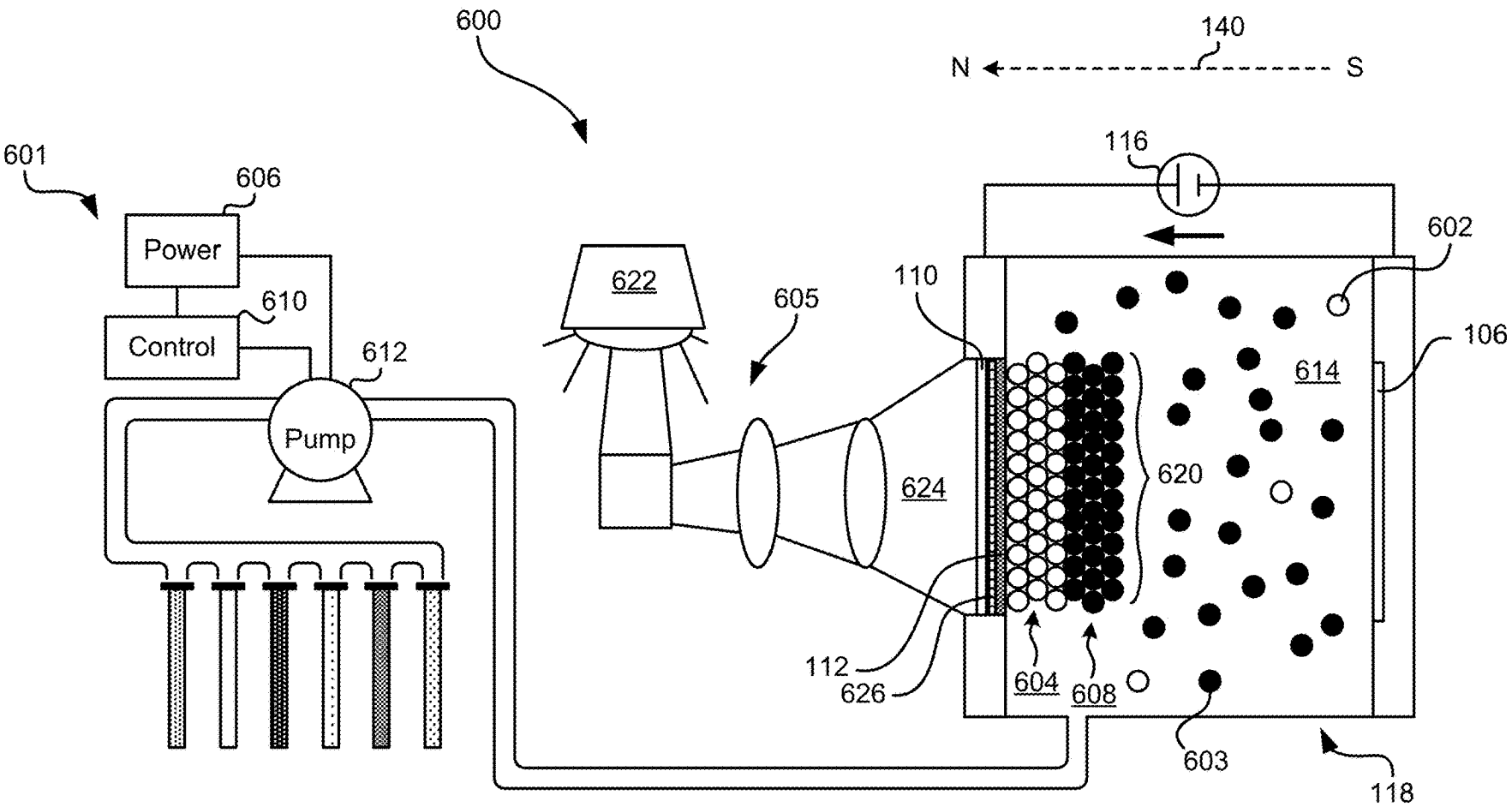
FIG. 6 is a schematic drawing of a system for electrophoretic deposition, according to one embodiment.

FIG. 6 depicts a simple schematic drawing for forming a structure 620 using an EPD device 600 comprising an EPD chamber 118 and an automated injection system 601, according to one embodiment. The automated injection system 601, according to one embodiment, may include a pump 612, a controller 610 for controlling pump operation and particle selection, and power 606 for each component. As shown in FIG. 6, there are six particle types to choose from for the first material, second material, $n^{th}$ material; however, the invention is not so limited, and any number of particle types, concentrations, sizes, etc., may be available for injecting into the EPD chamber 118, according to various embodiments.

In some approaches, the formed structure may have a plurality of layers; and include altering a condition in the EPD chamber for creating a gradient in composition, microstructure and/or density along the plane of deposition (x-y plane) and/or a thickness direction (z-direction) oriented perpendicular to the plane of deposition.

According to one embodiment, the structure 620 comprises a first layer 604 having a first composition, a first microstructure, and a first density and a second layer 608 above the first layer 604, the second layer 608 having at least one of: a second composition that is different than the first composition, a second microstructure that is different than the first microstructure, and a second density that is different than the first density. A gradient may exist between the first layer 604 and the second layer 608, and the first and second layers 604, 608 have a characteristic of being formed in an EPD chamber, as previously described. In some approaches, the gradient may exist in a z-direction perpendicular to the x-y plane between the first layer and the second layer formed above the first layer.

In one embodiment, the gradient may be a transition from at least one of: the first composition, the first microstructure, and the first density, to the at least one of: the second composition, the second microstructure, and the second density. That is to say, any of the composition, microstructure and/or density may change from the first layer 604 to the second layer 608, with any of the remaining properties being about the same, according to various embodiments.

For example, and not meant to be limiting to the invention in any way, an Nd—Fe—B magnet may include a first layer having a composition of Dy rich Dy—Fe—B and a second layer having a composition of $DyF_3$. For example, a magnet as part of a motor or generator stator will experience a rotating magnetic field as the electrical coils of the rotor pass. This can create regions of high demagnetizing forces near corners and sharp edges. A magnet with Dy rich regions near the corners may include fewer expensive components than a magnet with uniform Dy throughout. In this example, two properties, composition and magnetic response change from the first layer to the second layer.

Moreover, a gradient may affect one property, two properties, three properties or even other properties, such as melting point, freezing point, conductivity, rigidity, or any other mechanical property, chemical property, electrical property, magnetism, etc., as would be understood by one of skill in the art upon reading the present descriptions.

In another embodiment, the gradient from the first layer 604 to the second layer 608 may be abrupt, gradual, in small incremental steps, etc., as would be understood by one of skill in the art upon reading the present descriptions.

According to another embodiment, the first layer 604 and the second layer 608 may have a characteristic of being deposited above a non-planar electrode, e.g., as is described in more detail in FIGS. 2A-2C.

In some approaches, the first particles 602 in a solution may form a first layer 604, and the second particles 603 in a solution 614 may form a second layer 608. In some approaches, the first particles 602 and the second particles 603 may be the same material but have different concentrations in a solution 614. In other approaches, the first particles 602 and the second particles 603 may be different.

In some approaches, forming the first pattern and/or the second pattern may be dynamically altered to modify a gradient in composition, microstructure and/or density in the z-direction across a plurality of layers.

In various approaches, each layer may have particles that individually include a first material, second material, $n^{th}$ material from a powder dispersed in the deposition solution, as previously described. The powder of the material may be derived from materials such as neodymium, cobalt, samarium, iron, nickel, ferrite, boride, alloys comprising a combination thereof, etc. Methods to produce powder include grinding, crushing, etc. as known to one skilled in the art.

In some approaches, a layer may have particles of one material, e.g. iron, and a second layer may have particles of nickel. In other approaches, the first and second layer includes particles of the same material, but the composition or density of the material may be different. In other approaches, the first layer may include an alloy of two materials and the second layer may include a single material of the alloy. These examples are provided to describe possible approaches, and are not meant to be limiting in any way.

In some approaches, the second material may include a plurality of second particles having magnetic anisotropy, where the first particles of the first material and the second particles of the second material may be commonly aligned in the magnetic field.

In one embodiment, EPD may be used in conjunction with controlled electric field 140 patterns to direct the composition of deposited material in an x-y plane parallel to a plane of deposition, including multilayer deposition of a single pattern as well as dynamically changing patterns as the particles build up in the z-direction, perpendicular to the x-y plane. This technique enables, for example, permanent Nd—Fe—B magnets with a controlled z-direction concentration of Dy material.

Conventional methods of forming permanent magnets tend to be limited to uniform composition profiles. However, in one embodiment, because the electrophoretic deposition occurs only where the field is applied, precisely patterned x-y concentration profiles are possible by modifying the electrode pattern in this plane. To enable this capability, one electrode in a typical EPD system may be replaced with a photoconductive layer (such as α-H:Si) and a transparent or semi-transparent electrode, e.g., of indium tin oxide (ITO) and illuminated in specific regions using any number of light sources and/or light altering devices or mechanisms, such as a static mask, a dynamic pattern from a light altering or emitting mechanism, etc.

Referring to FIG. 6, a light source 622 may be provided to provide light 624 to a photoconductive layer 626 that becomes conductive in response to areas where the light 624 is shined thereon. In this approach, the first electrode 110 may be transparent or semi-transparent, thereby allowing light 624 from the light source 622 to reach the photoconductive layer 626. In FIG. 6, the substrate 112 extends to fully cover the photoconductive layer 626, but the invention is not so limited. In this or any other embodiment, the photoconductive layer 626 may be applied to the substrate 112, to the first electrode 110, may be a separate component in the device 600, may be shaped differently or the same as any other component to which it is applied, etc.

As shown in FIG. 6, the light 624 from the light source 622, in one embodiment, passes through a light altering mechanism 605, which may include one or more lenses or optical devices, one or more mirrors, one or more filters, one or more screens, or any other light altering mechanism as would be known to one of skill in the art that would be capable of providing one or more patterns to the light 624 (e.g., to alter the light 624 from the light source 622) prior to reaching the photoconductive layer 626, in various embodiments. In some embodiments, the light altering mechanism 605 may be capable of dynamically altering the light 624, according to user preferences, applications requirements, predefined patterns, spacings, durations, etc. According to some embodiments, light altering mechanism 605 may include a digital light processing (DLP) chip, laser scanning, light rastering, and/or a liquid crystal on silicon (LCoS) chip or array.

In other embodiments, the light altering mechanism may be positioned near to the photoconductive layer (not shown). The light from the light source, in one embodiment, passes through the light altering mechanism prior to reaching the photoconductive layer. According to several approaches, the light altering mechanism may include a LCoS array, one or more filters, one or more patterned screens, or any other light altering mechanism as would be known to one of skill in the art that would be capable of providing one or more patterns to the light (e.g., to alter the light from the light source).

In these embodiments, dynamic altering of the light may be greatly enhanced, as the light altering mechanism may be programmed to change over time to allow light to reach the photoconductive layer as desired by a user.

The light source 622 may be any light source capable of providing sufficient light 624 to shine upon designated areas of the photoconductive layer 626, as would be understood by one of skill in the art upon reading the present descriptions.

Other components shown in FIG. 6 of the EPD device 600 not specifically described herein may be chosen, selected, and optimized according to any number of factors, such as size limitations, power requirements, formation time, etc., as would be known by one of skill in the art.

Looking back to FIG. 5A, operation 504 of method 500 of forming a magnet includes sintering the formed structure to form a magnet. In some approaches before sintering the formed structure, the structure may be pressed by isostatic pressure or similar technical means. In some approaches, the formed structure may be a green body.

In some approaches, before the sintering of operation 504, the formed structure may be dried. Conventional drying techniques may used to dry the structure as would be understood by one having ordinary skill in the art upon reading the present descriptions, for example, supercritical drying, evaporation, etc.

In some approaches of operation 504, the formed structure produced by EPD may be sintered in a reducing atmosphere, such as forming gas, to produce a fully dense solid. The processing temperature for sintering of the formed structure may be significantly below the melting point of the solid. This avoids reduction of the magnetic properties, as would otherwise be seen at higher sintering temperatures. Moreover, the sintered solid may maintain the microstructure of the green body with an increased density, for example, the density may reach near 100% in the sintered solid magnet. Thus, the resultant permanent magnet may maintain a high coercivity represented in part by the microstructure of the solid and sintering at a temperature below the melting point of the material resists any melting of the solid that could sharply reduce the coercivity.

In some approaches, a temperature for sintering the green body may be less than a temperature of a melting point of the first material. For example, without intending to be limiting, a Fe—Ni green body may be sintered at about 50° C. under hydrogen gas for 30 minutes. In various approaches, the parameters of sintering of the green body may correlate to the conditions of thermal consolidation of the material as known by one skilled in the art.

Deposition and then sintering in this form may result in a highly anisotropic magnet which may have improved magnetic properties compared to a magnet produced from isotropic particles.

Conventional sintering methods are restrictive in designing a magnetic field shape using pole-pieces to produce permanent magnets since processing of isostatically pressed particles uses large magnetic fields to align the particles as they are pressed. In sharp contrast, the EPD process as described herein allows careful design of the magnetic field shape using pole-pieces to produce complex magnetic structures.

In some approaches, the functionally graded magnet formed from method 500 may be a permanent magnet.

Experiments

Greenbodies of $SmCo_5$ Magnets

Figure 7B:
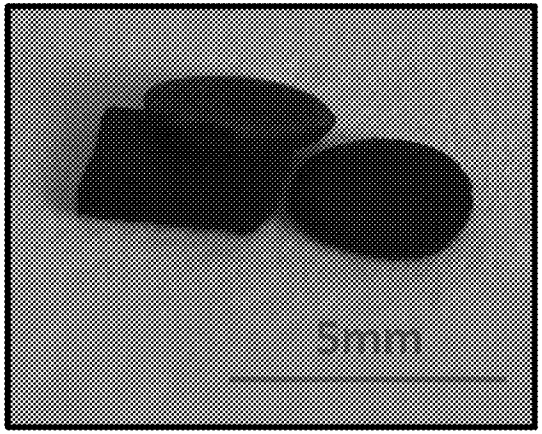
FIGS. 7A-7B are images of greenbodies of $SmCo_5$ magnets, according to one embodiment.
Figure 7A:
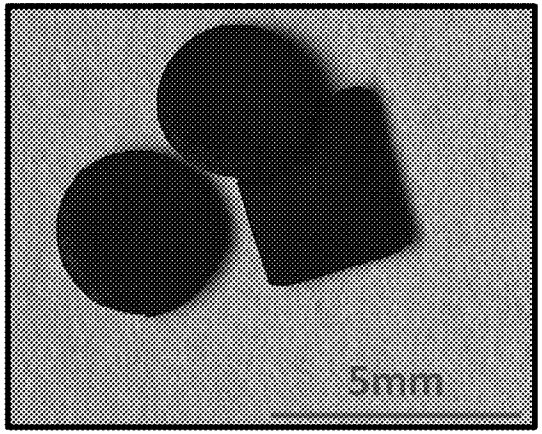

FIGS. 7A and 7B are images of samples of Sm and Co containing greenbodies. Illustrative examples are shown of regular shapes of cylinders and squares several millimeters in size and approximately 0.5 mm thick, as produced in a batch process using EPD techniques described herein.

Magnetic Properties

Figure 8A:
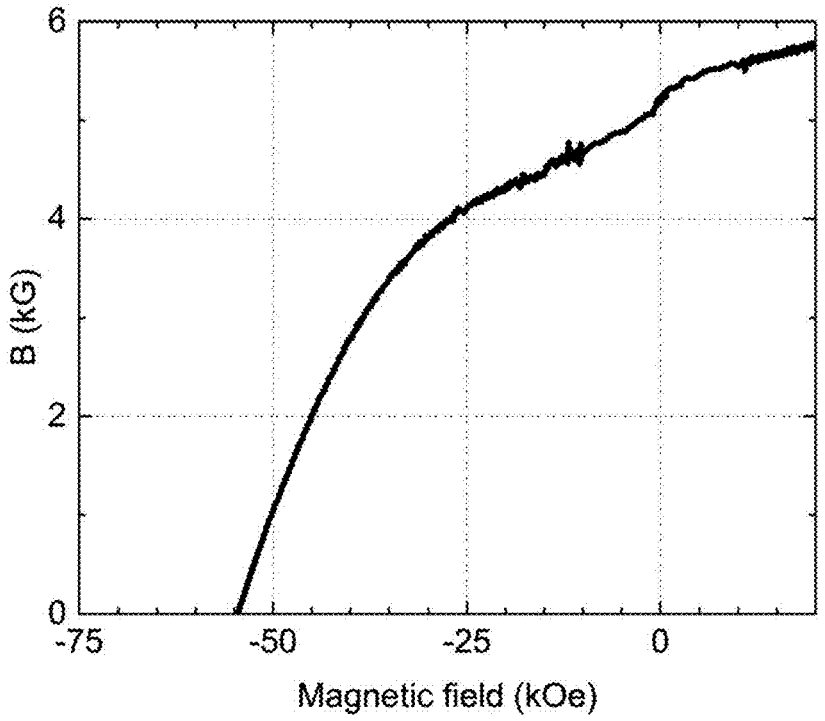
FIG. 8A is a plot of the second quadrant of one hysteresis loop at room temperature of a $SmCo_5$ magnet, according to one embodiment.

The greenbodies of $SmCo_5$ magnets shown in FIGS. 7A and 7B were thermally processed and characterized with hysteresis loops (magnetization as a function of externally applied magnetic field) at a variety of temperatures. These measurements were performed on samples of approximately 50 mg with a vibrating sample magnetometer (VSM) inside of a 16 Tesla superconducting magnet. The externally applied magnetic field was swept between +/−14 T (140 kOe) to obtain the isothermal magnetization at a series of temperatures both above and below ambient temperature. FIG. 8A is a plot showing the second quadrant of one hysteresis loop at room temperature (approximately 300 K, a relatively warm room) that clearly illustrates a coercivity of $H_{ci}$~55 kOe.

Figure 8B:
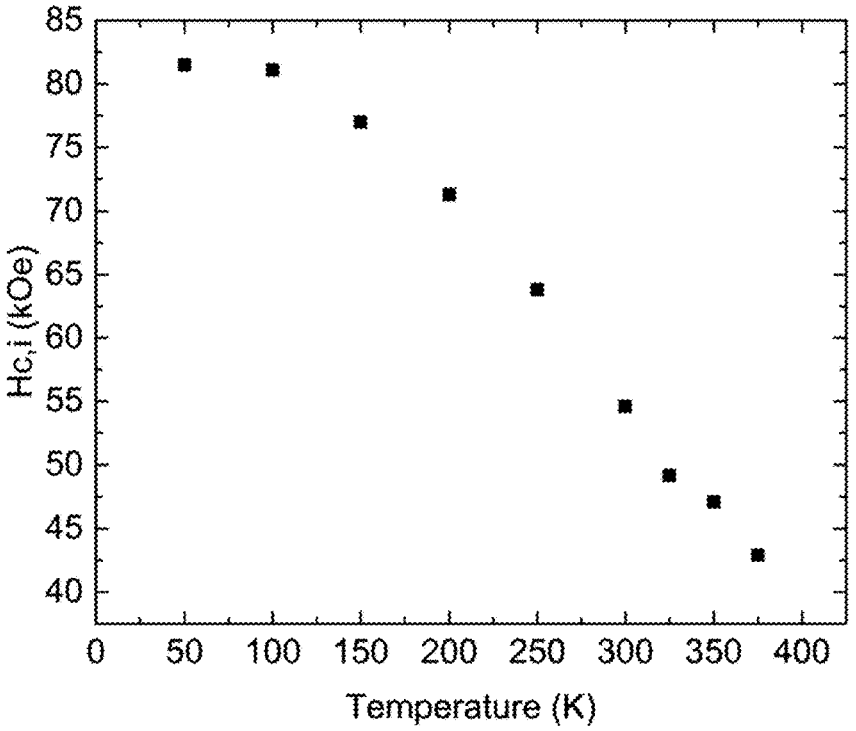
FIG. 8B is a plot of the coercivity as a function of temperature of a $SmCo_5$ magnet, according to one embodiment.

FIG. 8B is a plot of the coercivity $H_{ci}$ of the $SmCo_5$ magnet as a function of temperature showing that at temperatures above 100° C. (373K), the coercivity of the magnets is $H_{ci}$>40 kOe.

In Use

Various embodiments described herein use electrophoretic deposition to reduce the amount of raw materials used in magnet assembly. Permanent magnets are key elements of compact high power density motors and related actuators, as well as for sensors and transducers such as speakers. The techniques presented herein offer a methodology to make permanent rare earth magnets with much reduced waste material, and so is particularly valuable for producing small magnets, or magnets with novel or difficult to manufacture shapes.

The inventive concepts disclosed herein have been presented by way of example to illustrate the myriad features thereof in a plurality of illustrative scenarios, embodiments, and/or implementations. It should be appreciated that the concepts generally disclosed are to be considered as modular, and may be implemented in any combination, permutation, or synthesis thereof. In addition, any modification, alteration, or equivalent of the presently disclosed features, functions, and concepts that would be appreciated by a person having ordinary skill in the art upon reading the instant descriptions should also be considered within the scope of this disclosure.

While various embodiments have been described above, it should be understood that they have been presented by way of example only, and not limitation. Thus, the breadth and scope of an embodiment of the present invention should not be limited by any of the above-described exemplary embodiments, but should be defined only in accordance with the following claims and their equivalents.

What is claimed is:

1. A magnet, comprising:

a plurality of layers, each layer having a microstructure of sintered particles, wherein the microstructure has a physical characteristic of being sintered at a temperature that remains below the melting point of the magnet, wherein the microstructure of at least one of the layers is characterized by the sintered particles having preferentially aligned magnetic orientations in a first direction, wherein at least one of the layers has physical characteristics of being deposited by electrophoretic deposition according to a predefined three-dimensional pattern, wherein the layers have a physical characteristic of being deposited above a non-planar electrode, the physical characteristic being a non-planar surface corresponding to the non-planarity of the electrode.

2. The magnet as recited in claim 1, wherein all of the layers have a physical characteristic of being deposited by an electrophoretic deposition process.

3. The magnet as recited in claim 2, wherein a profile of the non-planar electrode is selected from the group consisting of: a curved profile, a conical profile, a polygon profile, and a circular profile.

4. The magnet as recited in claim 1, wherein the magnet is a permanent magnet.

5. The magnet as recited in claim 1, wherein each layer individually comprises at least one material selected from the group consisting of: neodymium, cobalt, samarium, iron, nickel, ferrite, boride, and a combination thereof.

6. The magnet as recited in claim 1, wherein at least one of the layers has a gradient in composition, microstructure and/or density in at least one direction.

7. The magnet as recited in claim 1, wherein the plurality of layers includes a first layer and a second layer formed above the first layer, wherein the first layer and/or the second layer has a gradient in composition, microstructure and/or density in a z-direction perpendicular to an x-y plane of the first layer.

8. The magnet as recited in claim 7, wherein the first and second layers have the same composition.

9. The magnet as recited in claim 7, wherein the second layer has different magnetic properties than the first layer.

10. The magnet as recited in claim 7, wherein particles of the second layer are characterized as having commonly aligned magnetic orientations in a second direction that is different than the first direction.

11. The magnet as recited in claim 7, wherein the plurality of layers includes a first layer and a second layer formed above the first layer, wherein the first and second layers have a gradient that includes a transition from a characteristic of the first layer selected from the group consisting of: a first composition, a first microstructure, and a first density of the first layer to a characteristic of the second layer selected from the group consisting of: a second composition that is different than the first composition, a second microstructure that is different than the first microstructure, and a second density that is different than the first density.

12. The magnet as recited in claim 1, wherein the plurality of layers has a gradient in composition, microstructure and/or density in a z-direction perpendicular to an x-y plane of a first layer.

13. The magnet as recited in claim 1, wherein a coercivity of the magnet is greater than about 10 kilo Oersteds at temperatures of at least 300 degrees Celsius.

14. The magnet as recited in claim 1, wherein the microstructure has a physical characteristic that substantially matches a microstructure of the particles before sintering.

15. The magnet as recited in claim 1, wherein one of the physical characteristics of being deposited by electrophoretic deposition is the particles in at least one layer being arranged in a predefined pattern.

16. The magnet as recited in claim 1, wherein one of the physical characteristics of being deposited by electrophoretic deposition is a second layer deposited onto the at least one layer, the second layer being arranged in a second predefined pattern, wherein the predefined pattern is complementary to the second predefined pattern.

17. The magnet as recited in claim 16, wherein the predefined pattern does not overlay the second predefined pattern.

18. A product, comprising:

a part having a plurality of layers of sintered magnetic anisotropic particles, each layer having a microstructure of the sintered particles, wherein the microstructure has a physical characteristic that substantially matches a microstructure of the particles before sintering, wherein the microstructure is characterized by the sintered particles having preferentially aligned magnetic orientations in a first direction, wherein the part is characterized by physical characteristics of formation by an electrophoretic deposition process, one of the physical characteristics being at least one layer deposited corresponding to a predefined pattern.

19. The product as recited in claim 18, wherein the part has a gradient of composition, microstructure and/or density in a thickness direction of the layers.

20. The product as recited in claim 18, wherein the part is a permanent magnet.

21. The product as recited in claim 18, wherein each layer individually comprises at least one material selected from the group consisting of: neodymium, cobalt, samarium, iron, nickel, ferrite, boride, and a combination thereof.

22. The product as recited in claim 18, wherein the part has a thickness in a range of greater than about 5 nanometers and less than about 1 centimeter.

23. The product as recited in claim 18, wherein the part has a coercivity greater than about 10 kilo Oersteds at temperatures of at least 300 degrees Celsius.

24. The product as recited in claim 18, wherein the microstructure has a physical characteristic of being sintered at a temperature that remains below the melting point of the part.

25. The product as recited in claim 18, wherein one of the physical characteristics of formation by the electrophoretic deposition process is particles in at least one layer being arranged in the predefined pattern.

26. The product as recited in claim 18, wherein one of the physical characteristics of formation by the electrophoretic deposition process is a second layer deposited onto the at least one layer, the second layer being arranged in a second predefined pattern, wherein the predefined pattern is complementary to the second predefined pattern.

27. The product as recited in claim 26, wherein the predefined pattern does not overlay the second predefined pattern.

28. The product as recited in claim 26, wherein gaps are present between the complementary predefined pattern, gaps being defined as an area having substantially no material present.

29. The product as recited in claim 26, wherein the second predefined pattern is a reverse pattern of the predefined pattern.

* * * * *